US006190021B1

(12) United States Patent
Huang

(10) Patent No.: US 6,190,021 B1
(45) Date of Patent: Feb. 20, 2001

(54) DOUBLE-WING TYPE LAMP HOLDER

(75) Inventor: Peter K. H. Huang, Taipei (TW)

(73) Assignee: Shining Blick Enterprises Co., Ltd., Taipei (TW)

( * ) Notice: Under 35 U.S.C. 154(b), the term of this patent shall be extended for 0 days.

(21) Appl. No.: 09/290,868

(22) Filed: Apr. 14, 1999

(51) Int. Cl.[7] ..... H01R 33/00

(52) U.S. Cl. ..... 362/227; 362/806; 362/227; 362/249; 362/123; 362/396; 362/391; 362/252

(58) Field of Search ..... 362/806, 227, 362/249, 123, 396, 391, 252

(56) References Cited

U.S. PATENT DOCUMENTS 5,645,342 * 7/1997 Chang ..... 362/806
5,839,819 * 11/1998 Pan ..... 362/252
5,839,820 * 11/1998 Huang ..... 362/252
5,908,238 * 6/1999 Huang ..... 362/391
5,913,597 * 6/1999 Lin ..... 362/226
6,056,418 * 5/2000 Hsu ..... 362/249

* cited by examiner

*Primary Examiner*—Sandra O'Shea
*Assistant Examiner*—Anabel M. Ton
(74) *Attorney, Agent, or Firm*—Dougherty & Troxell

(57) ABSTRACT

A lamp holder having two ribs perpendicularly raised from the periphery thereof at two opposite sides, and two smoothly arched clamping plates respectively connected to the ribs, the smoothly arched clamping plates each defining with the periphery of the lamp holder two clamping holes at two opposite sides of the ribs for holding a respective lead wire.

2 Claims, 4 Drawing Sheets

DOUBLE-WING TYPE LAMP HOLDER

BACKGROUND OF THE INVENTION

The present invention relates to a lamp holder for use in a decorative light set, and more particularly to such a lamp holder which has means to hold a number of lead wires in different directions.

A regular lit string comprises a plurality of lamps respectively connected to an electric wire. The lamps each have a respective lead wire connected to the electric wire to receive electricity from a power source. In recent years, a variety of figure lights have been disclosed, and have appeared on the market. These figure lights, when turned on, show a particular pattern, for example Santa Claus, star, Christmas tree, etc. Early figure lights were comprised of a figured lamp support, and a number of lamps installed in the figured lamp support and electrically connected together. Nowadays, net lights and knitting lights are intensively used to decorate houses, trees, etc. A net light or knitting light uses a big number of lead wires. U.S. Pat. No. 5,800,046 shows the use of a long belt to secure lead wires. However, the use of the long belt complicates the installation of the decorative light set. FIG. 1 shows a icicle lamp according to the prior art, in which each lamp holder 10 which holds a respective lamp bulb 13 has a positioning device 11 formed integral with its periphery to hold a lead wire 12, which is connected to the main wire 14. The design of the positioning device 11 enables the lamp holder 10 to hold the respective lamp bulb 13 in a direction perpendicular to the main wire 14. This structure of lamp holder 10 is practical for use in an icicle lamp, however it is not suitable for use in a net light or knitting light in which lead wires are set in different directions.

SUMMARY OF THE INVENTION

The present invention has been accomplished under the circumstances in view. It is the main object of the present invention to provide a lamp holder which is practical for use in any of a variety of decorative light sets including net lights, knitting lights, icicle lights. According to the preferred embodiment of the present invention, two clamping plates are connected to the periphery of the lamp holder at two opposite sides by a respective rib, each clamping plate defining with the periphery of the lamp holder two clamping holes at two opposite sides of the respective rib for holding a respective lead wire in a respective particular direction.

DETAILED DESCRIPTION OF THE PREFERRED EMBODIMENT

Figure 1:
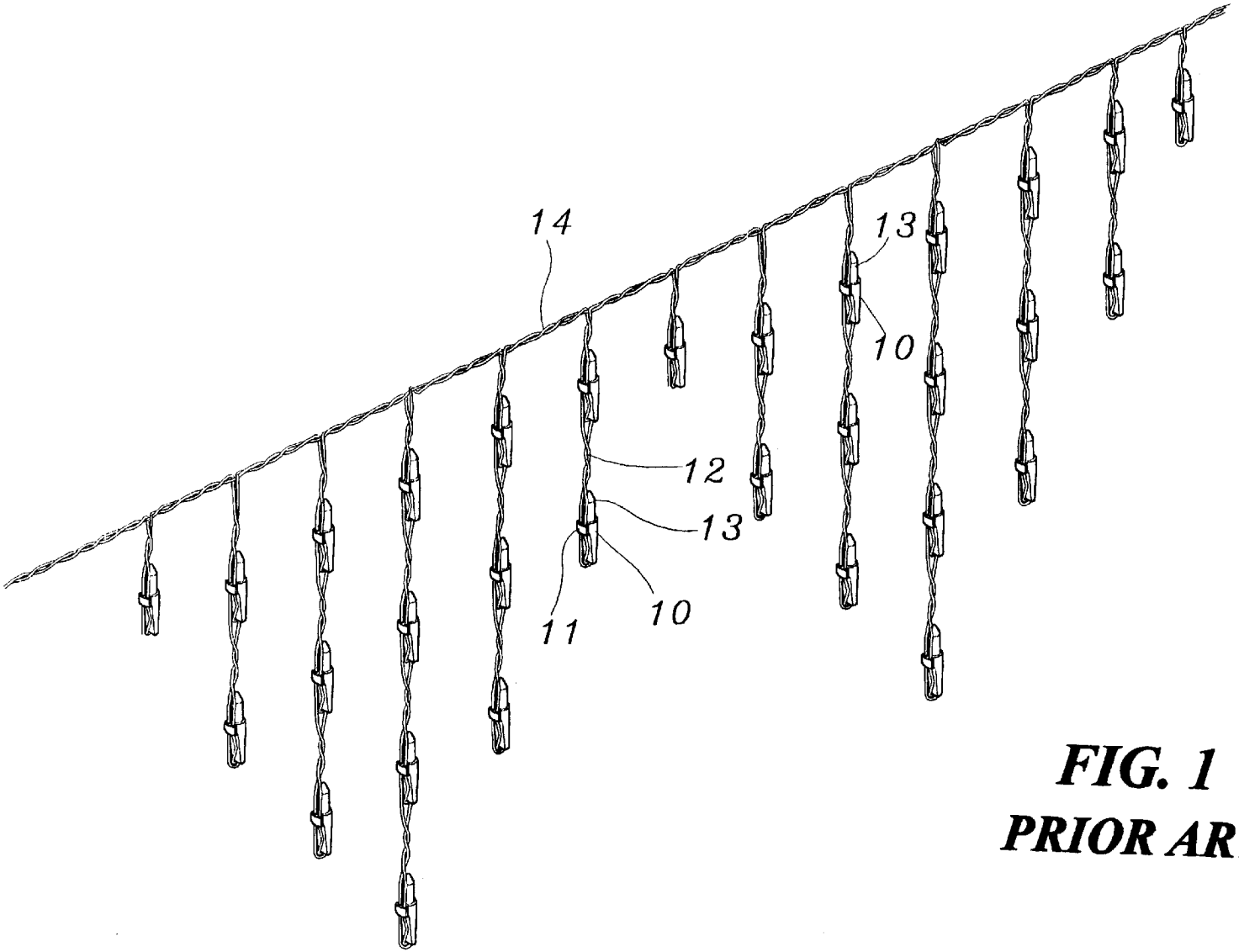
FIG. 1 PRIOR ART
FIG. 1 illustrates a conventional icicle lamp.
Figure 2:
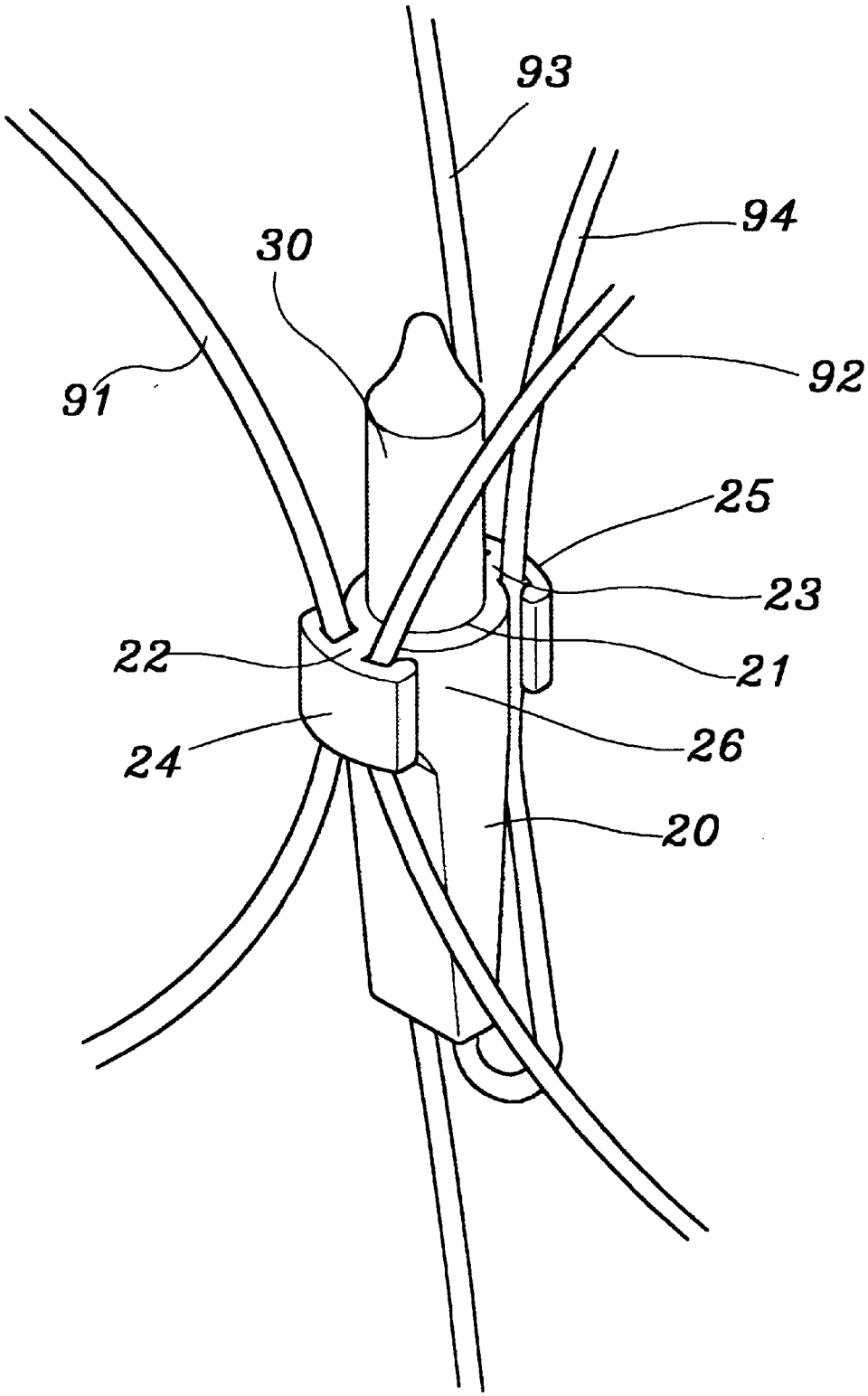
FIG. 2 illustrates lead wires fastened to a lamp holder according to the present invention.

Referring to FIG. 2, the lamp holder, referenced by 20, comprises an axially extended plug hole 21 at its one end, namely the top end, which receives a lamp bulb 30, and lead wire retainer means at two opposite sides of the periphery thereof to hold lead wires 91, 92, 93 and 94. As illustrated, one lead wire 94 is connected to the lamp holder 20 to provide electricity to the lamp bulb 30, and the other lead wires 91, 92 and 93 are extended in different directions.

Figure 4:
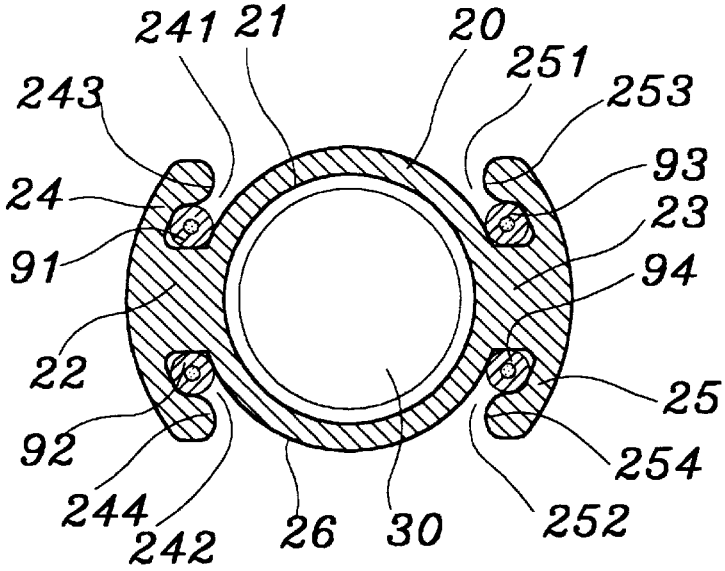
FIG. 4 is a cross sectional view of FIG. 3.
Figure 3:
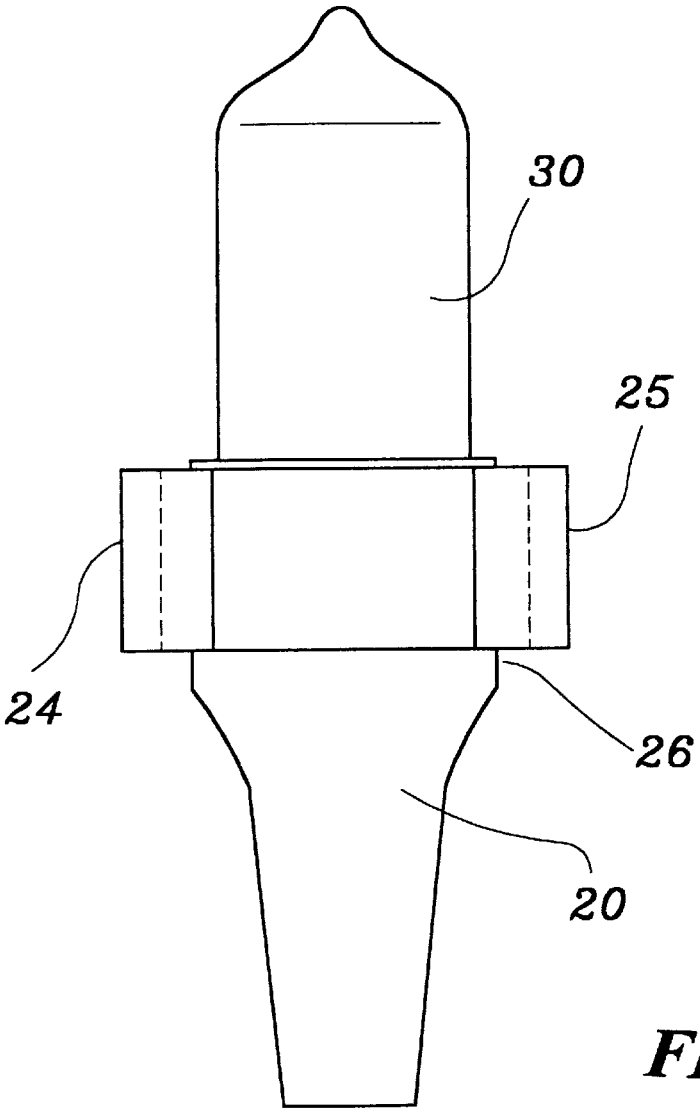
FIG. 3 is a front view in an enlarged scale of the lamp holder shown in FIG. 2.

Referring to FIGS. 3 and 4 and FIG. 2 again, two ribs 22 and 23 are perpendicularly raised from the periphery 26 of the lamp holder 20 at two opposite sides, and two smoothly arched clamping plates 24 and 25 are respectively connected to the ribs 22 and 23 at one end remote from the lamp holder 20. The arched clamping plates 24 and 25 each define with the periphery 26 of the lamp holder 20 two clamping holes 241 and 242; 251 and 252 at two opposite sides of the respective rib 22 or 23. As illustrated in FIG. 4, the arched clamping plates 24 and 25 each have two smoothly curved convex portions 244 and 243; 254 and 253 respectively formed at two opposite ends to narrow the entrance of the respective clamping holes 241 and 242; 251 and 252, enabling lead wires 91, 92, 93 and 94 to be respectively firmly retained to the clamping holes 241, 242, 251 and 252.

Referring to Figures from 2 through 4 again, the ribs 22 and 23 have a respective top side edge disposed flush with the topmost edge of the lamp holder 20. The ribs 22 and 23 and the smoothly arched clamping plates 24 and 25 are formed integral with the lamp holder 20. The ribs 22 and 23 are spaced from each other by 180°, and the clamping holes 241 and 242; 251 and 252 are respectively defined between the smoothly arched clamping plates 24 and 25 and the periphery 26 of the lamp holder 20 at two opposite sides of each of the ribs 22 and 23 for holding a respective lead wire.

Figure 5:
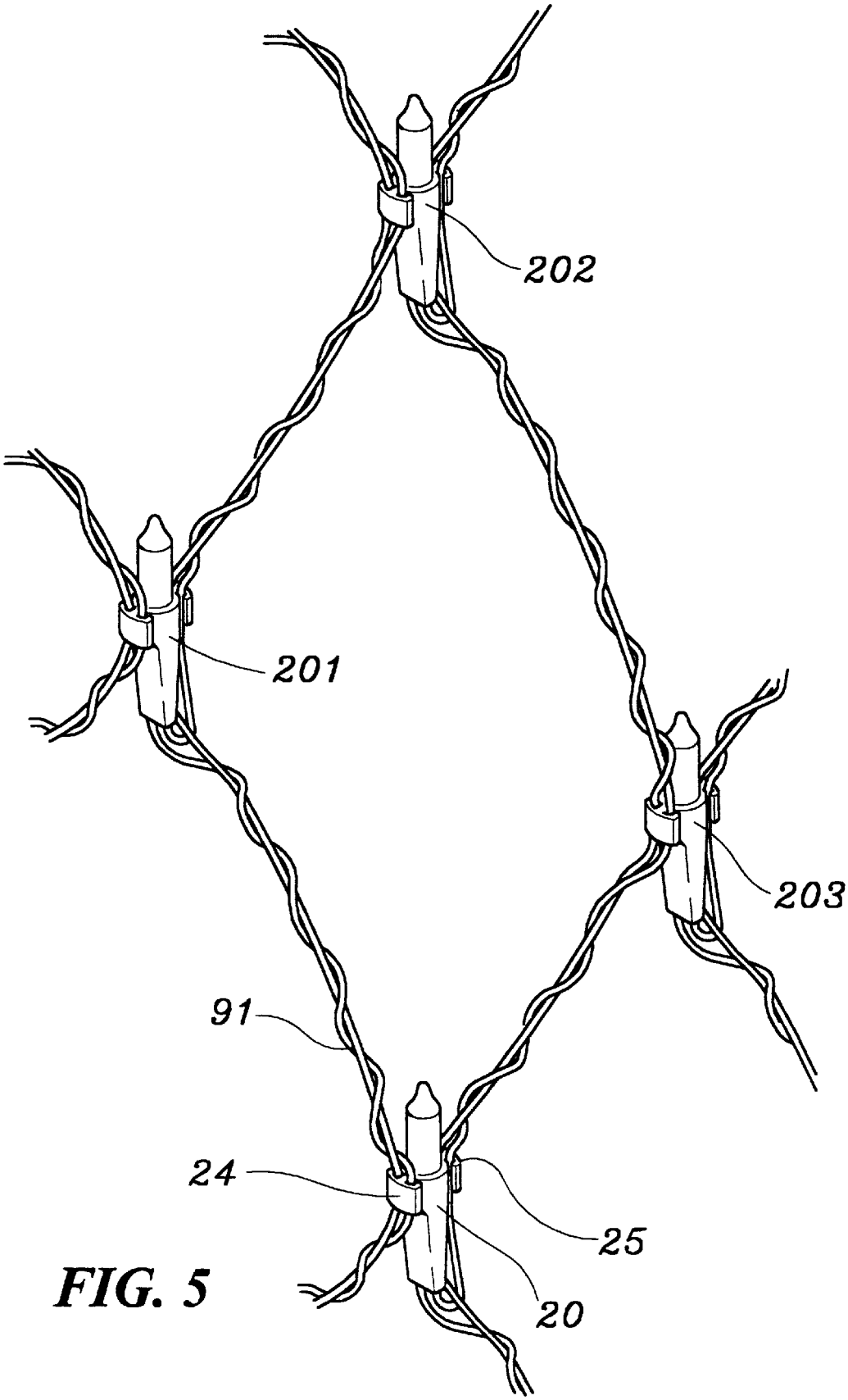
FIG. 5 is an applied view of the present invention used in a net light.

FIG. 5 shows an application example of the present invention. The lead wires 91 and 94 which are fastened to the clamping holes 241 and 242 at the lamp holder 20 are respectively connected to lamp holders 201, 202 and 203 to form a net light. Because the lamp holder 20 has four clamping holes 241, 242, 251 and 252 for holding lead wires from different directions, the invention is practical for use in making a net light or knitting light.

While only one embodiment of the present invention has been shown and described, it will be understood that various modifications and changes could be made thereunto without departing from the spirit and scope of the invention disclosed.

What is claimed is:

1. A lamp holder for a decorative light string comprising:

a) a lamp holder base having an opening to accept a lamp bulb therein, the lamp holder base having a circular cross-sectional configuration with a convexly curved outer surface;

b) first and second longitudinal ribs extending radially outwardly from diametrically opposite sides of the lamp holder base, each rib having a distal end; and, c) an arcuate clamping plate on the distal end of each rib, each arcuate clamping plate extending beyond opposite sides of the associated rib in a circumferential direction so as to form with a portion of the convexly curved outer surface of the lamp holder base, two clamping holes opening in opposite circumferential directions, each configured to clamp a wire of the light string therein.

2. The lamp holder of claim 1 further comprising a convexly curved entrance portion formed on each opposite circumferential side of each arcuate clamping plate, the convexly curved entrance portions bounding, with the convexly curved outer surface, openings of the clamping holes.

* * * * *